US010934783B2

(12) United States Patent
Amoudi et al.

(10) Patent No.: US 10,934,783 B2
(45) Date of Patent: Mar. 2, 2021

(54) DRILL BIT VALVE

(71) Applicant: Saudi Arabian Oil Company, Dhahran (SA)

(72) Inventors: Ahmad A. Amoudi, Medina (SA); Ossama R. Sehsah, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 168 days.

(21) Appl. No.: 16/150,368

(22) Filed: Oct. 3, 2018

(65) Prior Publication Data

US 2020/0109605 A1 Apr. 9, 2020

(51) Int. Cl.
*E21B 10/61* (2006.01)
*E21B 10/60* (2006.01)
*E21B 21/10* (2006.01)

(52) U.S. Cl.
CPC ..... *E21B 10/61* (2013.01); *E21B 10/602* (2013.01); *E21B 21/10* (2013.01)

(58) Field of Classification Search
CPC ..... E21B 10/602; E21B 10/60; E21B 10/61; E21B 21/00; E21B 21/10; E21B 34/10; E21B 47/013; E21B 47/01; E21B 47/017
See application file for complete search history.

(56) References Cited

U.S. PATENT DOCUMENTS 2,307,658 A * 1/1943 Appleby ..... E21B 7/18 175/317
2,828,107 A * 3/1958 Bobo ..... E21B 21/103 175/69
3,915,246 A * 10/1975 Sheshtawy ..... E21B 10/56 175/317
4,655,300 A 4/1987 Davis, Jr. et al.
4,941,951 A * 7/1990 Sheppard ..... E21B 21/08 175/48
5,009,272 A 4/1991 Walter
(Continued)

FOREIGN PATENT DOCUMENTS

EP 2795050 A2 10/2014
EP 2616630 B1 5/2018
(Continued)

OTHER PUBLICATIONS

Written Opinion for PCT/IB2018/058835, 8 pages (dated Jun. 18, 2019).

(Continued)

*Primary Examiner* — Jennifer H Gay
(74) *Attorney, Agent, or Firm* — Choate, Hall & Stewart LLP; Charles E. Lyon; Jialan Zhang

(57) ABSTRACT

An example drill bit includes a body that is connectable to a drill string. The body has a base configured to face downhole within a wellbore and a perimeter configured to face a wall of the wellbore. The body includes a first nozzle and a second nozzle. The first nozzle corresponds to a first channel that exits the body through the perimeter and the second nozzle corresponds to a second channel that exits the body through the base. The example drill bit also includes a bit cutter on the base of the body and a valve within the body. The valve is configured to move within the body to block either the first channel or the second channel.

21 Claims, 8 Drawing Sheets

(56) References Cited

U.S. PATENT DOCUMENTS

| | | | | |
|---|---|---|---|---|
| 5,533,571 | A * | 7/1996 | Surjaatmadja | E21B 21/10 166/222 |
| 5,720,355 | A * | 2/1998 | Lamine | E21B 10/60 175/27 |
| 6,571,886 | B1 * | 6/2003 | Sullivan | E21B 12/02 175/40 |
| 6,698,536 | B2 | 3/2004 | Moran et al. | |
| 8,844,633 | B2 | 9/2014 | Reitsma et al. | |
| 9,091,121 | B2 * | 7/2015 | Zhou | E21B 17/16 |
| 9,140,073 | B2 * | 9/2015 | Zhou | E21B 10/60 |
| 9,284,799 | B2 | 3/2016 | Reitsma et al. | |
| 9,328,574 | B2 | 5/2016 | Sehsah | |
| 9,376,875 | B2 | 6/2016 | Reitsma et al. | |
| 9,429,007 | B2 | 8/2016 | Reitsma et al. | |
| 9,845,648 | B2 * | 12/2017 | Clausen | E21B 21/08 |
| 2008/0142265 | A1 * | 6/2008 | Hall | E21B 4/14 175/56 |
| 2009/0200079 | A1 * | 8/2009 | Zaeper | E21B 21/08 175/48 |
| 2010/0108390 | A1 | 5/2010 | Teodorescu | |
| 2013/0161100 | A1 * | 6/2013 | Zhou | E21B 33/127 175/230 |
| 2013/0161102 | A1 * | 6/2013 | Zhou | E21B 43/26 175/267 |
| 2016/0326810 | A1 * | 11/2016 | Clausen | E21B 21/08 |
| 2017/0082214 | A1 * | 3/2017 | Hodgkinson | F16K 15/063 |
| 2020/0109605 | A1 * | 4/2020 | Amoudi | E21B 10/42 |

FOREIGN PATENT DOCUMENTS

| | | | |
|---|---|---|---|
| WO | WO-00/17488 | A1 | 3/2000 |
| WO | WO-2013/096361 | A2 | 6/2013 |
| WO | WO-2018/152388 | A1 | 8/2018 |
| WO | WO-2018/200287 | A1 | 11/2018 |
| WO | WO-2020/070546 | A1 | 4/2020 |

OTHER PUBLICATIONS

International Search Report for PCT/IB2018/058835, 5 pages (dated Jun. 18, 2019).

* cited by examiner

DRILL BIT VALVE

TECHNICAL FIELD

This specification relates generally to a valve for controlling the directional flow of fluid through a drill bit.

BACKGROUND

A drill bit is used for cutting through a formation to form a wellbore. In operation, the drill bit rotates at the end of a drill string to cut through the formation. The drill bit may have a body and a cutting edge that is also referred to as a bit cutter. As the drill bit cuts through the formation, fluid may be directed from the drill string through the body of the drill bit. This fluid is known as drilling fluid. Drilling fluid may improve the performance of the drill bit and may aid in maintenance of the drill bit. For example, the drilling fluid may cool, clean, and lubricate the drill bit during drilling.

SUMMARY

An example drill bit includes a body that is connectable to a drill string. The body has a base configured to face downhole within a wellbore and a perimeter configured to face a wall of the wellbore. The body includes a first nozzle and a second nozzle. The first nozzle corresponds to a first channel that exits the body through the perimeter and the second nozzle corresponds to a second channel that exits the body through the base. The example drill bit also includes a bit cutter on the base of the body and a valve within the body. The valve is configured to move within the body to block either the first channel or the second channel. The example drill bit may include one or more of the following features, either alone or in combination.

The valve of the drill bit may be configured to move within the body of the drill bit to block the first channel while leaving the second channel open or, alternatively, to block the second channel while leaving the first channel open. The valve of the drill bit body may include a first part that is controllable to block the first channel and a second part that is controllable to block the second channel.

The body of the drill bit may include a cavity and a hole that extends towards the base. The valve may include a first part including a first blocking structure configured to move within the cavity, and a second part including a second blocking structure and a shaft. The second blocking structure may be configured to move within the cavity and the shaft may be configured to move within the hole.

The first blocking structure may be at least partly cylindrical in shape and the second blocking structure may be semi-spherical in shape. The shaft may be configured to extend out of the base of the body when the second channel is blocked and the first channel is opened. The shaft may be configured to retract within the base of the body when the first channel is blocked and the second channel is opened.

The valve may be biased so that the first channel is blocked and the second channel is opened. The drill bit may include a spring to bias the valve so that the first channel is blocked and the second channel is opened. The spring may be compressible so that the first channel is opened and the second channel is blocked. The body of the drill bit may include a cavity and a hole that extends towards the base and the valve may include a shaft configured to move within the hole. The spring may be wound around at least part of the shaft. The drill bit may include a fluid channel arranged so that fluid entering the through the body collides with the valve biased by the spring. The spring may be configured so that collision with the fluid causes the spring to compress.

The first nozzle of the drill bit may be one among multiple first nozzles. Each of the multiple first nozzles may correspond to a channel that exits the body through the perimeter. The second nozzle of the drill bit may be one among multiple second nozzles. Each of the multiple second nozzles may correspond to a channel that exits the body through the base. The drill bit may include a number of first nozzles that is different than a number of second nozzles.

An example method includes rotating a drill bit. The drill bit includes a body. The body includes a base configured to face downhole within a wellbore and a perimeter configured to face a wall of the wellbore. The body includes a first nozzle and a second nozzle. The first nozzle corresponds to a first channel that exits the body through the perimeter and the second nozzle corresponds to a second channel that exits the body through the base. The example method includes controlling a valve within the drill bit to block the first channel and to open the second channel to allow drilling fluid to flow through the second channel. The example method includes controlling the valve within the drill bit to block the second channel and to open the first channel to allow the drilling fluid to flow through the first channel. The example method may include one or more of the following features, either alone or in combination.

The body of the drill bit may include a cavity and a hole that extends towards the base. A first part of the valve may include a first blocking structure configured to move within the cavity, and a second part of the valve may include a second blocking structure connected to the first blocking structure. Controlling the valve to block the first channel and to open the second channel may include moving the first blocking structure through the cavity so that the first blocking structure is in front of the first channel. Controlling the valve to block the second channel and to open the first channel may include moving the second blocking structure through both the cavity and the hole so that the second blocking structure is in front of the second channel.

Controlling the valve within the drill bit to block the second channel and to open the first channel may include applying fluid to the valve from a drill string. The fluid may apply pressure to the valve biased by a spring. The fluid pressure on the valve may compress the spring to move the valve within the body. Controlling the valve within the drill bit to block the first channel and to open the second channel may include moving the drill bit into contact with the formation. The example method may include obtaining a pressure measurement of fluid exiting the first channel or obtaining a pressure measurement of fluid exiting the second channel or both obtaining a pressure measurement of fluid exiting the first channel and fluid exiting the second channel.

The example method may include detecting a washout condition using pressure measurements from the fluid exiting the first channel and second channel. In the example method, the first channel may be blocked and second channel may be opened during drilling and the first channel may be opened and the second channel may be blocked during back reaming.

Any two or more of the features described in this specification, including in this summary section, can be combined to form implementations not specifically described in this specification.

The systems and processes described in this specification, or portions of the systems and processes, can be controlled by a computer program product that includes instructions that are stored on one or more non-transitory machine-readable storage media, and that are executable on one or more processing devices to control (for example, to coordinate) the operations described in this specification. The systems and processes described in this specification, or portions of the systems and processes, can be implemented using one or more processing devices and memory to store executable instructions to control various operations.

The details of one or more implementations are set forth in the accompanying drawings and the description below. Other features and advantages will be apparent from the description and drawings, and from the claims.

DESCRIPTION OF THE DRAWINGS

Like reference numerals in different figures indicate like elements.

DETAILED DESCRIPTION

Figure 1:
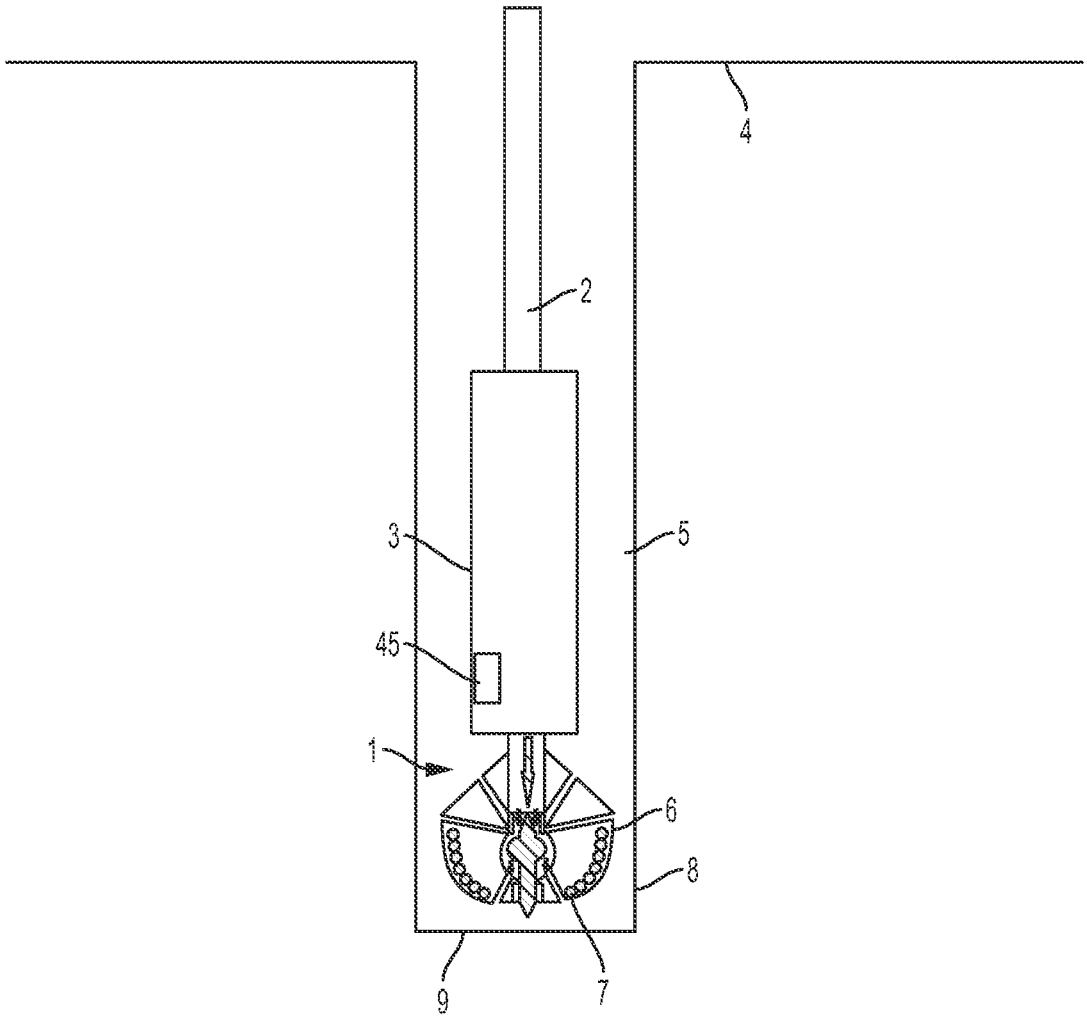
FIG. 1 is a cut-away, side view of an example drill bit and drill string in a wellbore.

Described in this specification are example valves for controlling the directional flow of fluid through a drill bit. A drill bit may be located at the end of a drill string and may be used for cutting through a formation to form a wellbore. In the case of a vertical wellbore, weight from the drill string may be applied to the drill bit as the drill bit rotates. The combined weight and rotation enable downhole cutting.

Fluid may be pumped from a wellhead on the surface through the drill string. This fluid is known as drilling fluid. Drilling fluid flows through the drill string and into the drill bit. The drilling fluid exits the drill bit and carries, to the surface, cuttings or debris produced by removing material from a formation. Drilling fluid may be water, another type of fluid, or a mixture of water and another type of fluid. The other types of fluids may include bentonite, polymers, or surfactants, for example. The type of fluid or mixture of fluids used as drilling fluid may depend on the composition of the formation to be drilled or other factors, such as soil conditions or composition.

Drilling fluid exiting the channels may clean a surface of the drill bit. The drilling fluid may also lubricate the bit cutter on the base of the drill bit. The drilling fluid may cool the drill bit and mix with cuttings or debris to facilitate their transport to the surface. The drilling fluid may also soften a formation before drilling. The drilling fluid flow thus may improve drill bit performance and reduce wear on the drill bit over time.

The drill bit may also enable back reaming. Back reaming includes a process for enlarging a wellbore hole cut by the drill bit. During back reaming, the drill bit rotates while drilling fluid is pumped and the drill string is moved uphole, for example, out of the wellbore. Drilling fluids mix with the reamings or cuttings, which are pumped to the surface. The result is an increase in the diameter of the wellbore.

The drilling fluid exiting the drill bit may also contribute to fluid pressure in the wellbore. Factors that can affect the fluid pressure in the wellbore may include a fluid flow rate of the drilling fluid being pumped from the surface, a weight of mud resulting from debris mixed with the drilling fluid, and the amount of drilling fluid exiting the drill bit. Controlling the flow of drilling fluid from the drill bit can regulate fluid pressure in the wellbore. Fluid pressure losses may include annular pressure loss (APL). APL occurs when fluid pressure between the drill string and the formation drops. APL can result in an influx of fluid, including drilling fluid, mud and cuttings, into the drill string.

The drilling fluid flow rate used during the formation of a wellbore may depend on the size and type of a wellbore. For example, a flow rate of 450 gallons per minute (GPM) may be used for drilling an 8.5 inch (215.9 mm) wellbore section and a flow rate of 800 GPM may be used for drilling a 12.25 inch (311.15 mm) wellbore section. A drilling fluid flow rate generated may also depend on the capacity of the pump.

An example drill bit includes a body containing a cavity and nozzles for directing fluid flow through, and out of, the drill bit. Channels may extend from the cavity to the nozzles to direct drilling fluid out of nozzles located on the base of the body or on the perimeter of the body. In this example, the base faces downhole, for example, towards the bottom of the wellbore. In this example, the perimeter faces the wall of the wellbore.

The nozzles regulate the flow of drilling fluid out of the drill bit. For example, the nozzles control the flow of drilling fluid from the drill string through the drill bit. The nozzles connect to corresponding channels through the body, through which the drilling fluid passes. The channels may be of different sizes and numbers in order to control the amount and pressure of the fluid exiting the drill bit. As noted, in some implementations, the drill bit may include nozzles on the base of the body to output drilling fluid toward the bottom of the wellbore and nozzles on the perimeter of the body to output drilling fluid toward the wall of the wellbore. A valve is located within the body's cavity. The valve is configured to move within the body to selectively open or to selectively block the channels exiting the drill bit. The position of the valve controls which channels are blocked, and which channels are not blocked/open. Accordingly, the position of the valve controls which channels can pass drilling fluid through the body and which channels are blocked from passing drilling fluid through the body.

The valve may be controlled from the surface by applying force to the drill bit or by applying pressure to the drill bit using drilling fluid. The valve may include different parts, each configured to block a different set of channels. For example, the valve may include a first part having a first blocking structure that blocks one or more channels exiting the perimeter of the drill bit. For example, the valve may include a second part having a second blocking structure that blocks one or more channels exiting the base of the drill bit. In some implementations, blocking performed by the first structure and the second structure is mutually exclusive. For example, when the first blocking structure blocks the channels exiting the perimeter, the second blocking structure does not block—or leaves open—the channels exiting the base. For example, when the second blocking structure blocks the channels exiting the base, the first blocking structure does not block—or leaves open—the channels exiting the perimeter. In another example, the valve may have a blocking structure configured to block or partially to block both channels exiting the base and channels exiting the perimeter. In another example, the valve may have a blocking structure configured to move within the drill bit body to open or partially to open both channels exiting the base and channels exiting the perimeter.

FIG. 1 shows an example of a drilling system containing an example drill bit of the type described in the preceding paragraphs. The system includes drill bit 1, drill string 2, and drill collar 3. As shown, drill bit 1 is connected to drill collar 3 within wellbore 5, and the resulting combined structure is connected to drill string 2. In operation, forces—both downhole and rotational—are applied from drill string 2 to drill bit 1. These forces cause drill bit 1 to move downhole and to rotate. These movements cause the drill bit to cut through formation 4 and thereby create or extend wellbore 5.

Figure 2:
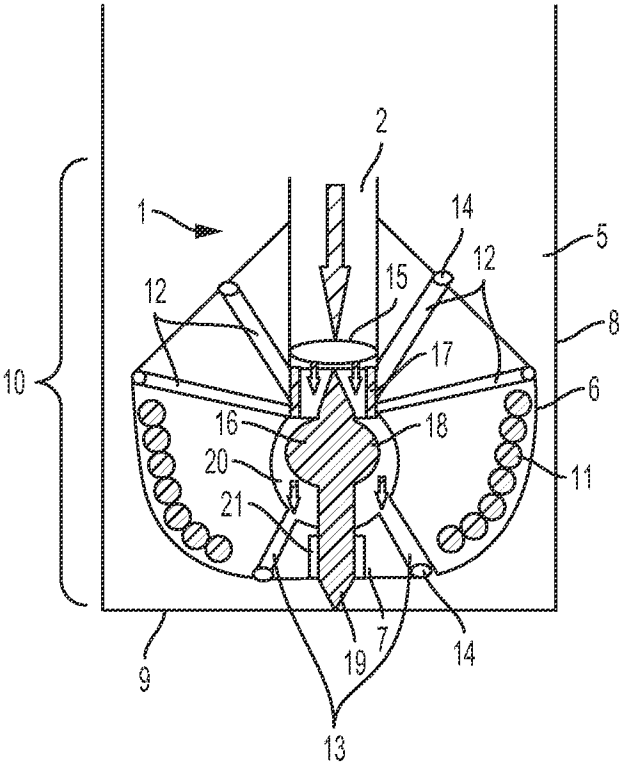
FIG. 2 is a cut-away, side view of an example drill bit during drilling.

FIG. 2 is a close-up view of components of example drill bit 1 of FIG. 1. Drill bit 1 includes base 7 configured to face the bottom 9 of wellbore 5 and perimeter 6 configured to face the sidewall 8 of wellbore 5. Drill bit 1 includes a body 10 and bit cutter 11 on the body. The bit cutter includes teeth or other structures configured to cut through soil and rock. Drill string 2 includes inlet 15, configured to pass drilling fluid flowing through body 10, for example, during operation of the drill bit.

In this example, body 10 includes cavity 20 and hole 21. Cavity 20 is in a fluid flow path of inlet 15 and is configured to receive drilling fluid via inlet 15. Cavity 20 has a semi-spherical shape to accommodate valve 16, which is described subsequently. Hole 21 has a cylindrical shape to accommodate shaft 19, which is described subsequently. Cavity 20 is in fluid communication with both hole 21 and inlet 15.

Body 10 includes channels 12 extending from cavity 20 through body 10 and exiting at perimeter 6. Body 10 includes channels 13 extending from cavity 20 through body 10 and exiting at base 7. Channels 12 and 13 each have a nozzle 14. Drilling fluid received via inlet 15 passes through cavity 20 and into one or more of the channels. In operation, drilling fluid passes through channels 12 to clean debris from perimeter 6 of drill bit 1 and to cool the drill bit. In operation, drilling fluid passes through channels 13 to clean, cool and lubricate base 7 of drill bit 1 during drilling. A valve 16 is configured to block either channels 12 or channels 13, leaving the unblocked channels open to allow drilling fluid to pass to their corresponding nozzles and exit the drill bit.

Valve 16 is configured to move within cavity 20 of body 10. In this example, valve 16 is configured to move within body 10 to block, selectively, either channels 12 or channels 13. Valve 16 includes a first part comprising a first blocking structure 17 configured to block channels 12 and a second part comprising a second blocking part 18 configured to block channels 13. Blocking structure 18 is semi-spherical in shape enabling it to fit within, and to move within, cavity 20. Blocking structure 17 is cylindrical in shape and is also configured to fit within, and move within, cavity 20. Valve 16 also includes shaft 19. Shaft 19 is at least partly cylindrical in shape to enable shaft 19 to fit within, and to move within, hole 21.

In the configuration of FIG. 2, drill bit 1 is in close proximity to the bottom 9 of wellbore 5. In this example, at least shaft 19 is in contact with bottom 9. As noted, drill bit 1 may be moved downhole by applying downward force from the surface on drill string 2 to move drill string 2 and drill bit 1 downhole. The downward force causes an opposite, upward force to be exerted on shaft 19. As a result of this upward force applied to the shaft, the shaft is forced to move uphole through hole 21 through base 7. Shaft 19 is connected to blocking structure 18, which is connected to blocking structure 17. Accordingly, the uphole movement of shaft 19 causes blocking structure 17 to move in front of channels 12. Therefore, in this position, fluid is prevented from flowing through channels 12. Likewise, the uphole movement of shaft 19 causes blocking structure 18 to move away from channels 13 and into a position in about the center of cavity 20. In this position, fluid is allowed to flow through channels 13. In other words, channels 12 are deactivated and channels 13 are activated.

Figure 3:
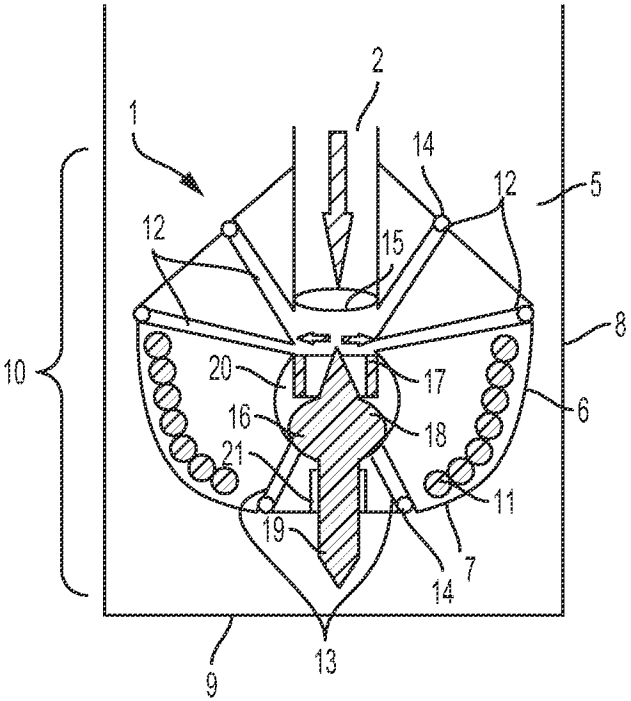
FIG. 3 is a cut-away, side view of an example drill bit during back reaming.

FIG. 3 shows the drill bit of FIG. 2 in an alternate configuration. In the configuration of FIG. 3, drill string 2 moves uphole. As a result, drill bit 1, including base 7 and bit cutter 11, moves uphole away from bottom 9 of the wellbore. Due to this movement, there is no longer a force of the formation against shaft 19. As a result, the weight of the valve causes shaft 19 to drop within cavity 20. That is, shaft 19 moves downward through hole 21, blocking structure 18 moves in front of channels 13, and blocking structure 17 moves away from channels 12, leaving channels 12 exposed to cavity 20. Accordingly, drilling fluid may pass through channels 12 and exit from the drill bit through corresponding nozzles of channels 12. Because blocking structure 18 is in front of channels 13, drilling fluid is prevented from exiting through those channels. In other words, channels 12 are activated and channels 13 are deactivated.

Figure 5:
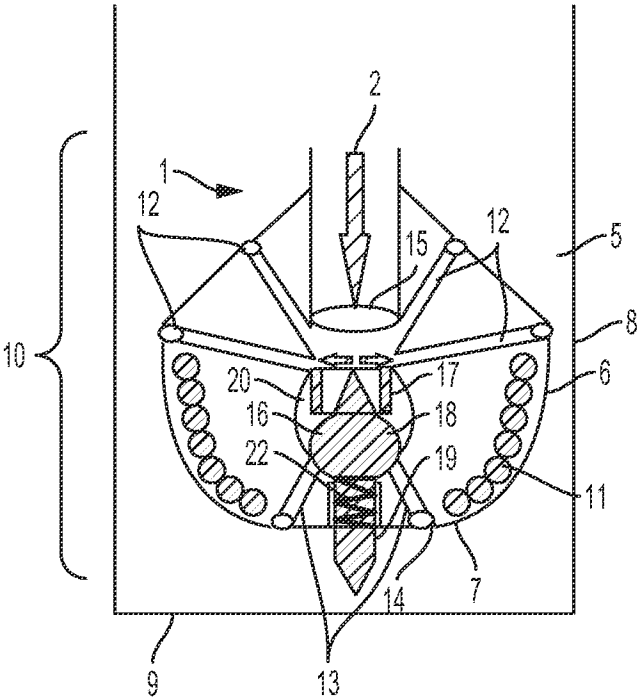
FIG. 5 is a cut-away, side view of an example drill bit during back reaming.
Figure 4:
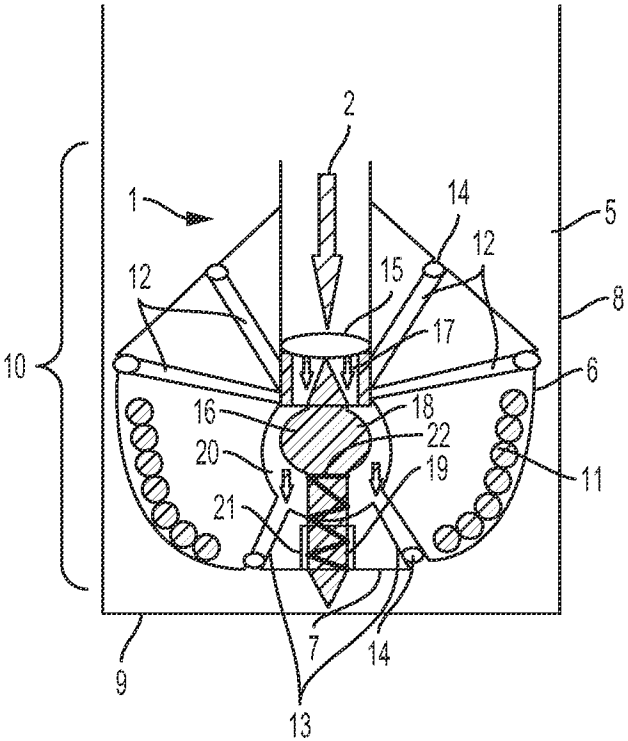
FIG. 4 is a cut-away, side view of an example drill bit during drilling.

FIGS. 4 and 5 include components of another example implementation of the drill bit described in this specification. The implementation of FIGS. 4 and 5 has various components in common with the implementation of FIGS. 2 and 3. For example, FIGS. 4 and 5 include: drill bit 1, drill string 2, drill collar 3, formation 4, wellbore 5, perimeter 6, base 7, sidewalls 8 of the wellbore, bottom 9 of the wellbore, drill bit body 10, bit cutter 11, channels 12, channels 13, nozzles 14 of each channels 12 and 13, inlet 15, cavity 20, hole 21, valve 16, first blocking structure 17, second blocking structure 18, and shaft 19. Components of the drill bit in FIGS. 4 and 5 have substantially the same structure as those of FIGS. 2 and 3. The operation of some of the components, however, is different in FIGS. 4 and 5 due to the presence of spring 22. In this regard, the implementation of FIGS. 4 and 5 include spring 22 to bias valve 16. Spring 22 may be a torsion spring that is wound around shaft 19, for example. When uncompressed, including when no downward force is applied to valve 16, spring 22 holds valve 16 in the position of FIG. 4. That is, spring 22 biases valve 16 so that valve 16 blocks channels 12 and does not block channels 13. When spring 22 is compressed—for example, when force is directed downhole to valve 16, spring moves as shown in FIG. 5. That is, spring 22 moves valve 16 so that valve 16 blocks channels 13 and does not block channels 12.

In the position of FIG. 4, spring 22 is in an uncompressed state. Spring 22 biases valve 16 so that valve 16 is in the center of cavity 20. Blocking structure 17 is in front of channels 12. Therefore, fluid is prevented from flowing through channels 12. Blocking structure 18 is not in front of channels 13 and fluid is allowed to flow through channels 13. Therefore, in this configuration, channels 12 are deactivated and channels 13 are activated. Because spring 22 is biased, the configuration of FIG. 4 may be achieved with, or without, upward force applied to valve 16 via shaft 19.

FIG. 5 shows the drill bit of FIG. 4 in an alternate configuration. In this configuration, spring 22 is compressed. Spring 22 may be compressed by increasing the flow rate of drilling fluid pumped from the surface. In this regard, the drilling fluid flows out of inlet 15 and collides with the top of valve 16. The resulting pressure on valve 16 overcomes the spring bias of the spring, producing the downward force that causes the spring to compress. As spring 22 compresses, shaft 19 moves through hole 21, blocking structure 18 moves in front of channels 13, and blocking structure 17 moves away from channels 12, leaving channels 12 exposed to cavity 20. Accordingly, drilling fluid may pass through channels 12 and exit from the drill bit through corresponding nozzles of channels 12. Because blocking structure 18 is in front of channels 13, drilling fluid is prevented from exiting through those channels. Therefore, in this configuration, channels 12 are activated and channels 13 are deactivated.

Figure 6:
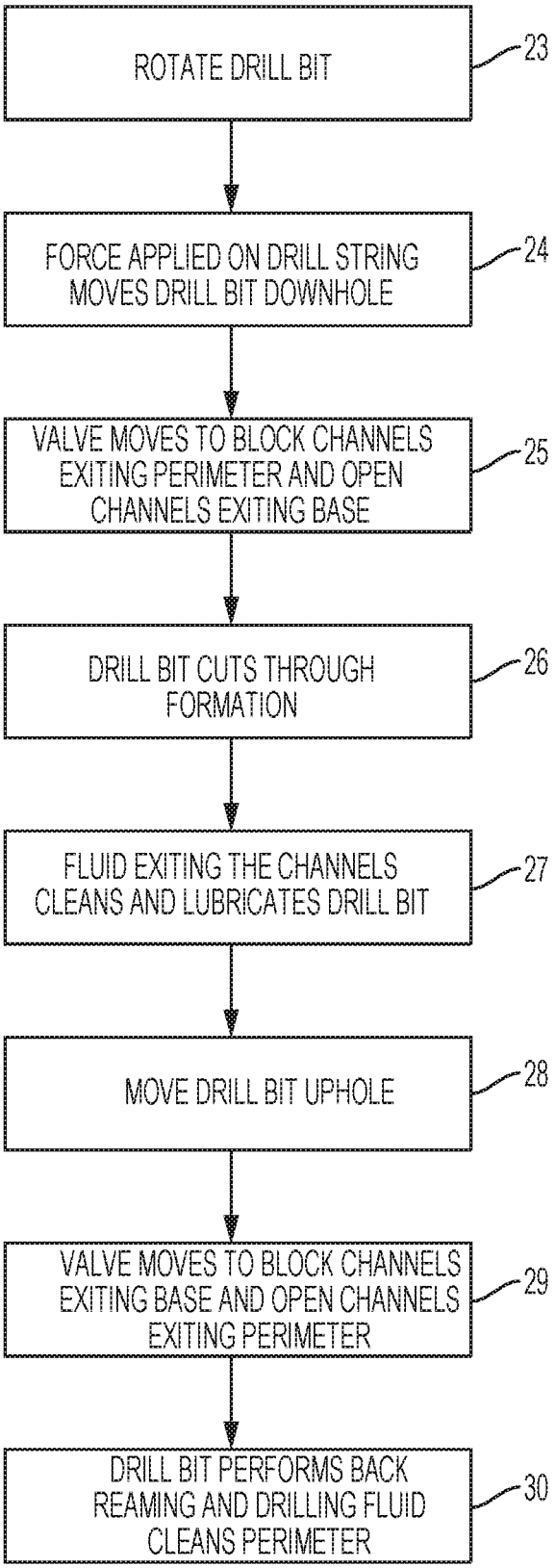
FIG. 6 is a flowchart that shows an example process for operating a drill bit in a wellbore.

FIG. 6 shows operations of an example process for operating the drill bit of FIGS. 2 and 3 in a wellbore and for controlling fluid flow through the drill bit. According to the example process, drill bit 1 is rotated (23) on drill string 2. A force from the surface is applied on drill string 2 to move (24) drill string 2 and drill bit 1 downhole. Base 7 of drill bit 1 and bit cutter 11 move into contact with the bottom 9 of wellbore 5. A force of contact between the bottom of the wellbore and shaft 19 creates an opposite (for example, an equal and opposite) upward force on shaft 19. The shaft is thus forced to move uphole through hole 21. Valve 16 then moves to block channels 12 exiting perimeter 6 and to open (25) fluid flow through channels 13 exiting base 7. In this configuration, valve 16 is in the center of cavity 20. This is similar to the configuration shown in FIG. 2. Drill bit 1 cuts (26) through formation 4 to form wellbore 5. Fluid exiting the channels 13 at the base of the drill bit cleans and lubricates (27) the drill bit.

The drill string is then pulled uphole, thereby causing the drill bit to move (28) uphole. Drill bit, including base 7 and bit cutter 11, moves uphole away from the bottom 9 of the wellbore. As a result, there is no longer a force of the formation against shaft 19. Valve 16 thus moves within shaft 19 into a position at the bottom of the cavity 20. In this position, the blocking structure 18 moves to block (29) or deactivate channels 13 and blocking structure 17 of valve 16 moves away from channels 12 to open (29) or activate channels 12. The position of the drill bit is in a configuration shown in FIG. 3. Drilling fluid is now allowed to pass through channels 12. In this position, drill bit performs back reaming and drilling fluid exiting channels 12 cleans (30) the perimeter of drill bit 1. Nozzles 14 of channels 12 provide turbulent flow of fluid exiting channels 12 for a larger portion of the horizontal section than the nozzles 14 of channels 13.

Figure 7:
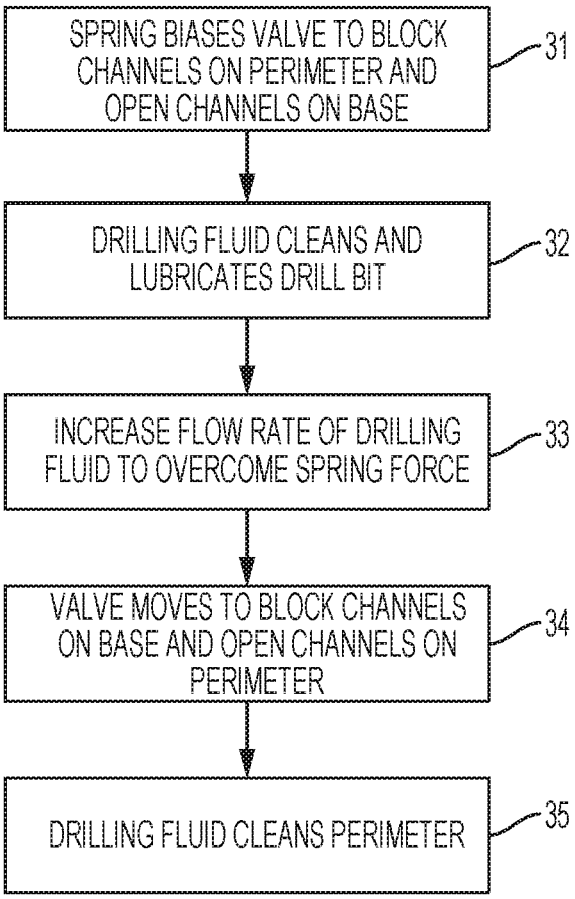
FIG. 7 is a flowchart that shows an example process for operating a drill bit in a wellbore.

FIG. 7 shows operations of an example process for operating the drill bit of FIGS. 4 and 5 in a wellbore and for controlling drilling fluid flow through the drill bit. According to the example process, spring 22 on valve 16 biases (31) valve 16. Valve 16 is positioned in the center of cavity 20. Blocking structure 17 is positioned to block fluid flow through channels 12 and fluid is permitted to flow through channels 13. The position of the drill bit at this point is as shown in FIG. 4. In this position, the drill bit may cut through rock within the wellbore. Drilling fluid exiting channels 13 at the base of the drill bit clean and lubricate (32) the drill bit. The flow rate of drilling fluid pumped from the surface is increased (33). The fluid pressure acting on valve 16 is sufficient to overcome the spring force biasing valve 16. Spring 22 is compressed and valve 16 moves (34) downhole to block channels 13 and allow fluid flow through channels 12, as shown in FIG. 5. In this position, the drill bit may be performing back reaming. Drilling fluid exiting channels 12 cleans (35) the perimeter of the drill bit.

The spring may be manufactured with a certain spring constant so that it will be compressed when an amount of pressure from the drilling fluid is applied to the spring. The drilling fluid flow rate in part controls the pressure applied to the spring. In an example, the spring may be manufactured so that it will remain uncompressed at a certain drilling fluid flow rate, during drilling, and then, at an increased drilling fluid flow rate, is compressed. The spring may be manufactured so that when the drilling fluid flow rate is doubled, the spring is compressed or when the drilling fluid flow rate reduced by half, the spring is uncompressed. In this example, the position of the valve may be precisely controlled by the drilling fluid flow rate.

In the example processes of FIG. 6 and FIG. 7, controlling the valve to block channels 12 and to open channels 13 and controlling the valve to block the channels 13 and to open channels 12 may be mutually exclusive. This selective operation of the channels on the base and channels on the perimeter allows for the drill bit to be used with low flow rate pumps. The fluid that is circulating from the drill bit may be reduced because not all channels 12 and 13 are activated at the same time. A low flow rate pump is a pump having a lower capacity to circulate drilling fluids. An example pump for this operation may include a pump capable of producing a flow rate of about 450 GPM. This flow rate may be useful for drilling a 8%-inch wellbore.

Figure 11:
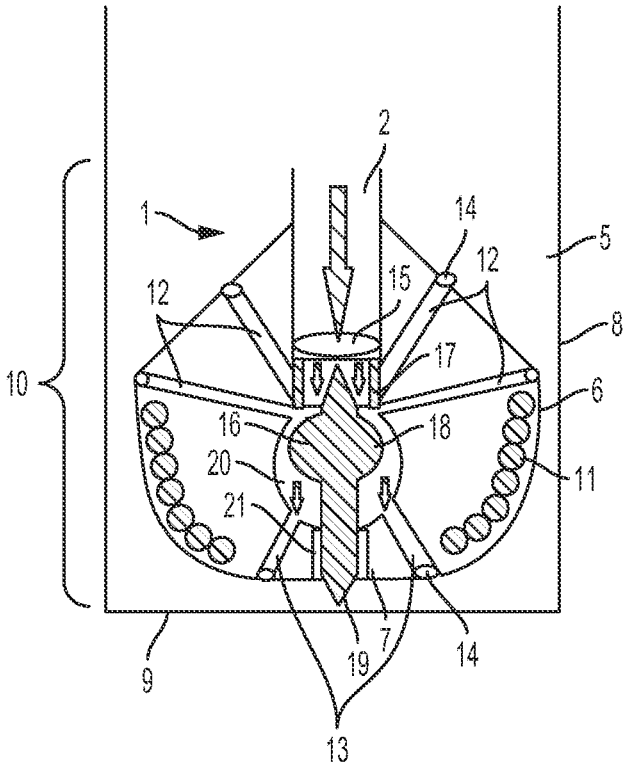
FIG. 11 is a cut-away, side view of an example drill bit during having channels that are partially open.

In other example configurations, the valve 16 may be moved to a position where some of the channels are partially open. Using mechanisms previously described, valve may be moved to an alternate configuration where channels 12 may be partially activated, as shown in the configuration of FIG. 11. The position of the valve within the drill bit is in an intermediate configuration relative to the position of the valve in FIG. 2 and the position of the valve in the configuration of FIG. 3. In this example configuration, valve 16 partially blocks the channels 12.

In some implementations, at least one channel is open at all times so that there is a constant circulating path of drilling fluid into and through the drill bit body. In some implementations, both channels 12 and channels 13 can be activated at the same time.

Figure 9:
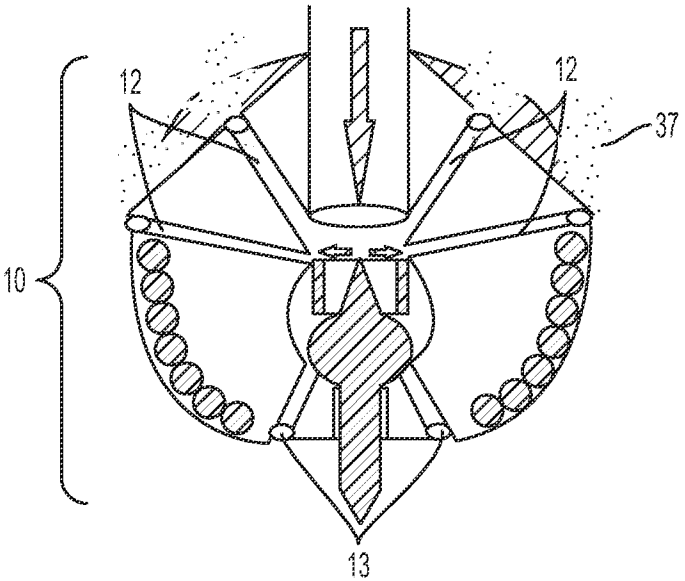
FIG. 9 is a cut-away, side view of an example drill bit having a valve to direct fluid to clear accumulated debris from the drill bit.
Figure 8:
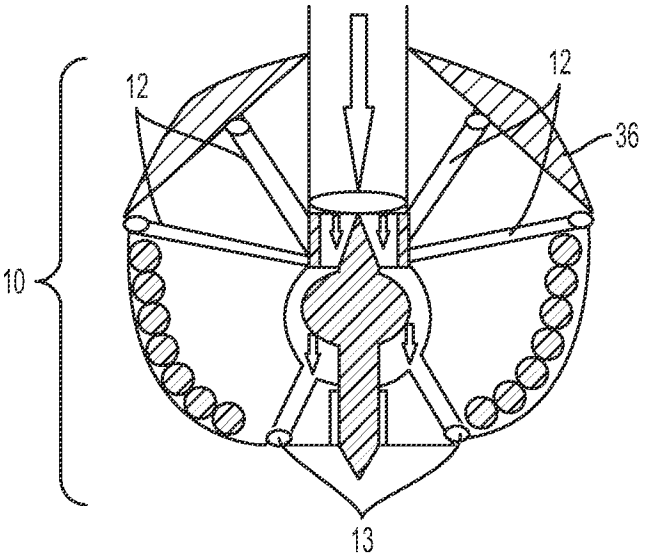
FIG. 8 is a cut-away, side view of an example drill bit having accumulated debris during drilling operations.

FIG. 8 is a cut-away, side view of an example drill bit that has accumulated debris 36 during drilling operations. In an example, controlling the flow of drilling fluid through, and out of, body 10 may be used to clear debris from the perimeter of the drill bit as shown in FIG. 9. Initially, channels 13 may be activated and channels 12 may be deactivated. Using mechanisms previously described, the valve may be moved to an alternate configuration where channels 13 are deactivated and channels 12 are activated, as shown in FIG. 9. The valve then may be returned to the configuration of FIG. 8, where channels 13 may be activated and channels 12 may be deactivated. This process may be repeated multiple times, selectively activating and deactivating the channels. Repeating the selective activation and deactivation of channels 12 and 13 creates turbulence 37 in the drilling fluid exiting the channels as shown in FIG. 9.

The body 10 of the example drill bits of FIGS. 1 to 5, 8 and 9 has four channels 12 exiting the perimeter 6 of the drill bit and two channels 13 exiting the base 7 of the drill bit. In other examples, the number of peripheral and base channels may be more or less. For example, there may only be one channel exiting the base and one channel exiting the perimeter. In some implementations, the number of channels exiting the perimeter and the number of channels exiting the base may be different.

In some implementations, the position of the valve and which channels are activated may be determined by obtaining pressure measurements of the drilling fluid exiting the drill bit. Pressure measurements may be obtained using a pressure sensor located on the drill bit or on a separate device at or near the surface or deployed downhole. A pressure sensor 45 may be incorporated into the outer surface of drill collar 3, as shown in FIG. 1. The expected pressure of fluid exiting a drill bit from the channels at the base and the expected pressure of fluid exiting a drill bit at the perimeter may be predetermined. This value may be obtained through testing or calculated based on the total bit nozzle area described subsequently, the fluid weight, and the fluid flow rate. If the total bit nozzle area of channels exiting the perimeter is different from that of channels exiting the base, the expected pressure of the fluid exiting the channels at the perimeter would be different from that of fluid exiting the channels at the base. A pressure measurement obtained during operation of the drill will therefore indicate which channels, 12 or 13, are activated.

The mechanisms for controlling fluid flow in a well may also function as a diagnostic tool, which is able to detect a washout in the drill string based on the fluid pressure observed in the wellbore. A washout is a part of the wellbore that has been enlarged due to removal of material during drilling or circulation. This may cause pressure losses in the wellbore. Fluid pressure may be observed using pressure sensors mounted to any point along the drill string or part of a separate device deployed downhole from the surface. For example, pressure sensor 48 as shown in FIG. 1 may be incorporated into the outer surface of drill collar 3.

Figure 10:
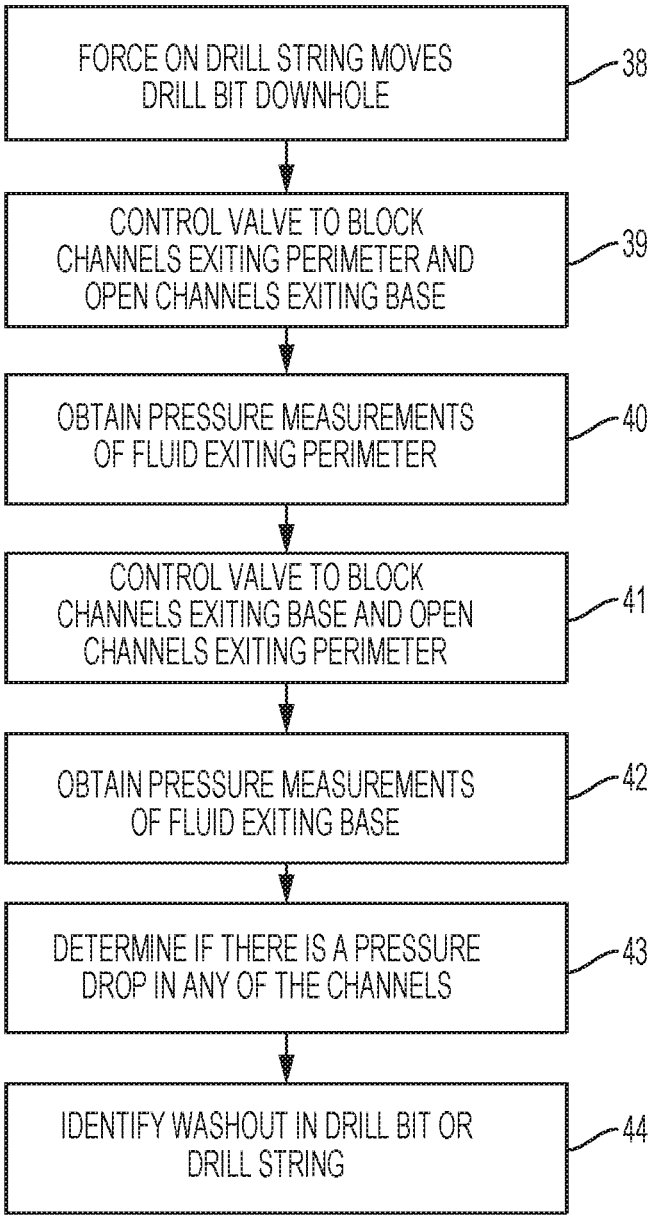
FIG. 10 is a flowchart that shows an example process for controlling fluid flow through a drill bit to detect a washout.

FIG. 10 is a flowchart showing operations of an example process for operating a drill bit and a drill string to detect a washout. According to the process, force is applied to the drill string to move (38) the drill bit downhole. Valve 16 is controlled (39) to block channels 12 and to open channels 13. In this position, valve 16 is in the center of cavity 20 and shaft 19 is within the base of the drill bit as shown in FIG. 2. Pressure measurements are obtained (40) from drilling fluid exiting channels 13 of base 7. Valve 16 is controlled (41) to block channels 13 and to open channels 12. In this position, valve 16 is at the bottom of the cavity and shaft 19 is extended out of the base of body 10 as shown in FIG. 3. Pressure measurements are obtained (42) from drilling fluid exiting channels 12 of perimeter 6. From the measurements, it is determined (43) if there is a pressure drop in channels 12 or channels 13. Measurements are compared with previous measurements or a predetermined baseline. If a pressure drop is determined then a washout is identified (44) in the drill string or drill bit.

The channels which are activated or opened may depend on the drilling operations being performed. Drilling fluid flowing out the base may be used to clean, cool, or lubricate the drill bit during drilling. Drilling fluid flowing out of the perimeter of the drill bit may clean the perimeter of the drill bit and lower the APL in a wellbore. Drilling fluids flowing out of the perimeter may also clean, cool or lubricate the drill bit during back reaming. The mechanisms for actuating the valve may be controlled from the surface by applying weight from the surface on the drill string or applying fluid pressure through a pump actuated at the surface.

In some implementations, the number of channels extending toward the perimeter of the drill bit does not equal the number of channels extending toward the base of the drill bit. This discrepancy in the number of channels results in pressure variations, which provide an indication of the position in which the valve is operating. The pressure of the fluid exiting the drill bit may be controlled by the total bit nozzle area. The total bit nozzle area is the total flow area of the nozzles combined. The flow area of each nozzle and the number of nozzles contribute to the total bit nozzle area. The total bit nozzle area may be separately calculated for the nozzles located at the perimeter of the drill bit and the nozzles located at the base of the drill bit. Increasing total bit nozzle area results in decreased fluid pressure of the fluid exiting the drill bit when the fluid weight and flow rate of the fluid is constant. If the total bit nozzle area of the nozzles located at the perimeter is larger than the nozzles located at the base, the fluid pressure of the fluid exiting the perimeter will be lower than the fluid pressure of fluid exiting the base. The predicted fluid pressure exiting the nozzles may be predicted if the total bit nozzle area, fluid weight and flow rate are known. Therefore, it is possible to identify which channels are open and the position of the valve, from pressure measurements obtained during drill bit operation.

The example drill bits described in this specification may be configured to form a wellbore for different types of wells including, but not limited to, water wells and hydrocarbon wells, such as oil wells or gas wells.

The systems and processes described in this specification and their various modifications may be controlled at least in part, using one or more computers using one or more computer programs tangibly embodied in one or more one or more non-transitory machine-readable storage media. A computer program can be written in any form of programming language, including compiled or interpreted languages, and it can be deployed in any form, including as a stand-alone program or as a module, part, subroutine, or other unit suitable for use in a computing environment. A computer program can be deployed to be executed on one computer or on multiple computers at one site or distributed across multiple sites and interconnected by a network.

Actions associated with controlling the systems and processes can be performed by one or more programmable processors executing one or more computer programs to control all or some of the operations described previously. All or part of the systems and processes can be controlled by special purpose logic circuitry, such as, an FPGA (field programmable gate array), an ASIC (application-specific integrated circuit), or both an FPGA and an ASIC.

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass storage devices for storing data, such as magnetic, magneto-optical disks, or optical disks. Non-transitory machine-readable storage media suitable for embodying computer program instructions and data include all forms of non-volatile storage area, including by way of example, semiconductor storage area devices, such as EPROM (erasable programmable read-only memory), EEPROM (electrically erasable programmable read-only memory), and flash storage area devices; magnetic disks, such as internal hard disks or removable disks; magneto-optical disks; and CD-ROM (compact disc read-only memory) and DVD-ROM (digital versatile disc read-only memory).

Elements of different implementations described may be combined to form other implementations not specifically set forth previously. Elements may be left out of the systems described without adversely affecting their operation or the operation of the system in general. Furthermore, various separate elements may be combined into one or more individual elements to perform the functions described in this specification.

Other implementations not specifically described in this specification are also within the scope of the following claims.

What is claimed is:

1. A drill bit comprising:

a body that is connectable to a drill string, the body having a base configured to face downhole within a wellbore and a perimeter configured to face a wall of the wellbore, the body comprising a first nozzle and a second nozzle, the first nozzle corresponding to a first channel that exits the body through the perimeter, the second nozzle corresponding to a second channel that exits the body through the base;

a bit cutter on the base of the body; and a valve within the body, the valve being configured to move within the body to block either the first channel or the second channel;

where a first part of the valve comprises a first blocking structure, where a second part of the valve comprises a second blocking structure connected to the first blocking structure, and where the first blocking structure is at least partly cylindrical in shape and the second blocking structure is semi-spherical in shape to accommodate the valve.

2. The drill bit of claim 1, where the valve is configured to move within the body to block the first channel while leaving the second channel open during drilling, and where the valve is configured to block the second channel while leaving the first channel open during back reaming.

3. The drill bit of claim 2, where the valve comprises a first part that is controllable to block the first channel and a second part that is controllable to block the second channel.

4. The drill bit of claim 1, further comprising a spring to bias the valve so that the first channel is blocked and the second channel is opened;

where the spring is compressible so that the first channel is opened and the second channel is blocked.

5. The drill bit of claim 4, where the body comprises a cavity and a hole that extends towards the base;

where the valve comprises a shaft configured to move within the hole; and where the spring is wound around at least part of the shaft.

6. The drill bit of claim 4, where the drill bit comprises a fluid channel arranged so that fluid entering the through the body collides with the valve biased by the spring.

7. The drill bit of claim 6, where the spring is configured so that collision with the fluid causes the spring to compress.

8. The drill bit of claim 1, further comprising at least one pressure sensor, where the at least one pressure sensor is located on the drill bit.

9. A drill bit comprising:

a body that is connectable to a drill string, the body having a base configured to face downhole within a wellbore and a perimeter configured to face a wall of the wellbore, the body comprising a first nozzle and a second nozzle, the first nozzle corresponding to a first channel that exits the body through the perimeter, the second nozzle corresponding to a second channel that exits the body through the base;

a bit cutter on the base of the body; and a valve within the body, the valve being configured to move within the body to block either the first channel or the second channel, where the body comprises a cavity and a hole that extends towards the base, where the valve comprises a first part that comprises a first blocking structure configured to move within the cavity, and a second part that comprises a second blocking structure and a shaft, the second blocking structure being configured to move within the cavity and the shaft being configured to move within the hole, and where the shaft is configured to extend out of the base of the body when the second channel is blocked and the first channel is opened.

10. The drill bit of claim 9, where the shaft is configured to retract within the base of the body when the first channel is blocked and the second channel is opened.

11. The drill bit of claim 9, where the valve is biased so that the first channel is blocked and the second channel is opened.

12. The drill bit of claim 9, where the first nozzle is one among multiple first nozzles, each of the multiple first nozzles corresponding to each of multiple first channels that exit the body through the perimeter; and where the second nozzle is one among multiple second nozzles, each of the multiple second nozzles corresponding to each of multiple second channels that exit the body through the base.

13. The drill bit of claim 12, where a number of first nozzles is different than a number of second nozzles.

14. The drill bit of claim 9, where the first blocking structure is at least partly cylindrical in shape and the second blocking structure is semi-spherical in shape to accommodate the valve.

15. A method comprising:

rotating a drill bit, the drill bit comprising a body, the body having a base configured to face downhole within a wellbore and a perimeter configured to face a wall of the wellbore, the body comprising a first nozzle and a second nozzle, the first nozzle corresponding to a first channel that exits the body through the perimeter, the second nozzle corresponding to a second channel that exits the body through the base;

controlling a valve within the drill bit to block the first channel and to open the second channel to allow drilling fluid to flow through the second channel;

controlling the valve within the drill bit to block the second channel and to open the first channel to allow the drilling fluid to flow through the first channel; and obtaining a pressure measurement using at least one pressure sensor, where the at least one pressure sensor is located on the drill bit, where obtaining the pressure measurement further comprises at least one of:

obtaining a pressure measurement of fluid exiting the first channel; and obtaining a pressure measurement of fluid exiting the second channel.

16. The method of claim 15, where the body comprises a cavity and a hole that extends towards the base, a first part of the valve comprising a first blocking structure configured to move within the cavity, and a second part of the valve comprising a second blocking structure connected to the first blocking structure;

where controlling the valve to block the first channel and to open the second channel comprises moving the first blocking structure through the cavity so that the first blocking structure is in front of the first channel; and where controlling the valve to block the second channel and to open the first channel comprises moving the second blocking structure through both the cavity and the hole so that the second blocking structure is in front of the second channel.

17. The method of claim 15, where controlling the valve within the drill bit to block the second channel and to open the first channel comprises applying fluid to the valve from a drill string.

18. The method of claim 17, where the fluid applies pressure to the valve biased by a spring, the fluid pressure on the valve compressing the spring to move the valve within the body.

19. The method of claim 15, where controlling the valve within the drill bit to block the first channel and to open the second channel comprises moving the drill bit into contact with the formation.

20. The method of claim 15, further comprising:

detecting a washout condition using pressure measurements from the fluid exiting the first channel and second channel.

21. The method claim 15, where the first channel is blocked and second channel is opened during drilling; and where the first channel is opened and the second channel is blocked during back reaming.

* * * * *